US011004595B2

(12) United States Patent
Yang et al.

(10) Patent No.: US 11,004,595 B2
(45) Date of Patent: May 11, 2021

(54) COIL COMPONENT AND METHOD OF MANUFACTURING THE SAME

(71) Applicant: SAMSUNG ELECTRO-MECHANICS CO., LTD., Suwon-Si (KR)

(72) Inventors: Ju Hwan Yang, Suwon-Si (KR); Byeong Cheol Moon, Suwon-Si (KR); Byung Soo Kang, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 222 days.

(21) Appl. No.: 16/126,400

(22) Filed: Sep. 10, 2018

(65) Prior Publication Data

US 2019/0304671 A1 Oct. 3, 2019

(30) Foreign Application Priority Data

Mar. 28, 2018 (KR) ..... 10-2018-0035867

(51) Int. Cl.

| | |
|---|---|
| ***H01F 27/36*** | (2006.01) |
| ***H01F 17/00*** | (2006.01) |
| ***H01F 27/29*** | (2006.01) |
| ***H01F 41/04*** | (2006.01) |
| ***H01F 27/32*** | (2006.01) |

(Continued)

(52) U.S. Cl.

CPC ..... *H01F 27/36* (2013.01); *H01F 17/0013* (2013.01); *H01F 27/292* (2013.01);

(Continued)

(58) Field of Classification Search

CPC ..... H01F 27/36; H01F 27/324; H01F 27/362; H01F 27/365; H01F 27/292;

(Continued)

(56) References Cited

U.S. PATENT DOCUMENTS 9,126,491 B2 * 9/2015 Ichikawa ..... B60L 53/38
9,583,251 B2 * 2/2017 Moon ..... H01F 27/292

(Continued)

FOREIGN PATENT DOCUMENTS

JP 58184710 A * 10/1983 ..... H01F 27/36
JP 2005-310863 A 11/2005

(Continued)

*Primary Examiner* — Mang Tin Bik Lian
(74) *Attorney, Agent, or Firm* — Morgan, Lewis & Bockius LLP

(57) ABSTRACT

A coil component includes a body having one surface and the other surface opposing each other in one direction and a plurality of wall surfaces connecting the one surface and the other surface to each other, a coil part including a coil pattern embedded in the body and forming at least one turn about one direction, first and second external electrodes connected to the coil part, formed, respectively, on both end surfaces opposing each other among the plurality of wall surfaces of the body and extending to one surface of the body, a shielding layer including a cap part disposed on the other surface of the body and a side wall part disposed on each of the plurality of wall surfaces of the body except both the end surfaces of the body, an insulating layer formed between the body and the shielding layer, and a seed layer formed between the insulating layer and the shielding layer.

15 Claims, 12 Drawing Sheets

(51) Int. Cl.
*H01F 17/04* (2006.01)
*H01F 27/28* (2006.01)

(52) U.S. Cl.
CPC ..... *H01F 27/324* (2013.01); *H01F 41/041* (2013.01); *H01F 2017/0073* (2013.01); *H01F 2017/048* (2013.01); *H01F 2027/2809* (2013.01)

(58) Field of Classification Search
CPC .... H01F 27/366; H01F 27/363; H01F 27/361; H01F 17/0013; H01F 17/04; H01F 2017/048; H01F 2017/008; H01F 2017/0073; H01F 41/041; H01F 41/046
See application file for complete search history.

(56) References Cited

U.S. PATENT DOCUMENTS

2006/0220737 A1* 10/2006 Sanderson ..... H03B 5/1841 330/69
2012/0242447 A1* 9/2012 Ichikawa ..... B60L 11/182 336/84 C
2012/0274432 A1* 11/2012 Jeong ..... H01F 17/0033 336/192
2013/0293334 A1* 11/2013 Shin ..... H01F 17/0033 336/192
2014/0159854 A1* 6/2014 Samala ..... H01F 17/0006 336/84 C
2016/0268038 A1* 9/2016 Choi ..... H01F 27/255
2017/0162316 A1* 6/2017 Endo ..... H01F 27/2804
2017/0200682 A1* 7/2017 Lin ..... H01L 24/97
2017/0311448 A1 10/2017 Kawabata
2018/0096783 A1* 4/2018 Fukuda ..... H01F 17/04
2018/0166211 A1* 6/2018 Takatsuji ..... H01F 17/04
2018/0286568 A1* 10/2018 Suzuki ..... H01F 41/122

FOREIGN PATENT DOCUMENTS

JP 2017-054891 A 3/2017
JP 2017-199896 A 11/2017

* cited by examiner

COIL COMPONENT AND METHOD OF MANUFACTURING THE SAME

CROSS-REFERENCE TO RELATED APPLICATION(S)

This application claims the benefit of priority to Korean Patent Application No. 10-2018-0035867 filed on Mar. 28, 2018, in the Korean Intellectual Property Office, the disclosure of which is incorporated herein by reference in its entirety.

TECHNICAL FIELD

The present disclosure relates to a coil component and a method of manufacturing the same.

BACKGROUND

An inductor, a coil component, is a typical passive electronic component used in an electronic device, together with a resistor and a capacitor.

As the performance of electronic devices gradually increases and electronic devices become smaller, the number of electronic components used in electronic devices is increasing and electronic components are becoming smaller.

For the above reasons, demand for eliminating noise sources such as electromagnetic interference (EMI) in electronic components is gradually increasing.

In current commonly used EMI shielding technologies, electronic components are mounted on a substrate, and the electronic components and the substrate are simultaneously surrounded by a shield can.

SUMMARY

An aspect of the present disclosure may provide a coil component that may reduce leakage flux.

An aspect of the present disclosure may also provide a coil component that may substantially maintain component characteristics while reducing leakage flux.

According to an aspect of the present disclosure, a coil component may include: a body having one surface and the other surface opposing each other in one direction and a plurality of wall surfaces connecting the one surface and the other surface to each other, a coil part including a coil pattern embedded in the body and forming at least one turn about the one direction, first and second external electrodes connected to the coil part, formed, respectively, on both end surfaces opposing each other among the plurality of wall surfaces of the body and extending to one surface of the body, and a shielding layer including a cap part disposed on the other surface of the body and a side wall part disposed on each of the plurality of wall surfaces of the body except both the end surfaces of the body.

Here, the coil component may further include an insulating layer disposed on each of the plurality of wall surfaces of the body except both the end surfaces of the body and formed between the body and the shielding layer, and a seed layer formed between the insulating layer and the shielding layer.

At least a portion of the seed layer may penetrate into the insulating layer.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
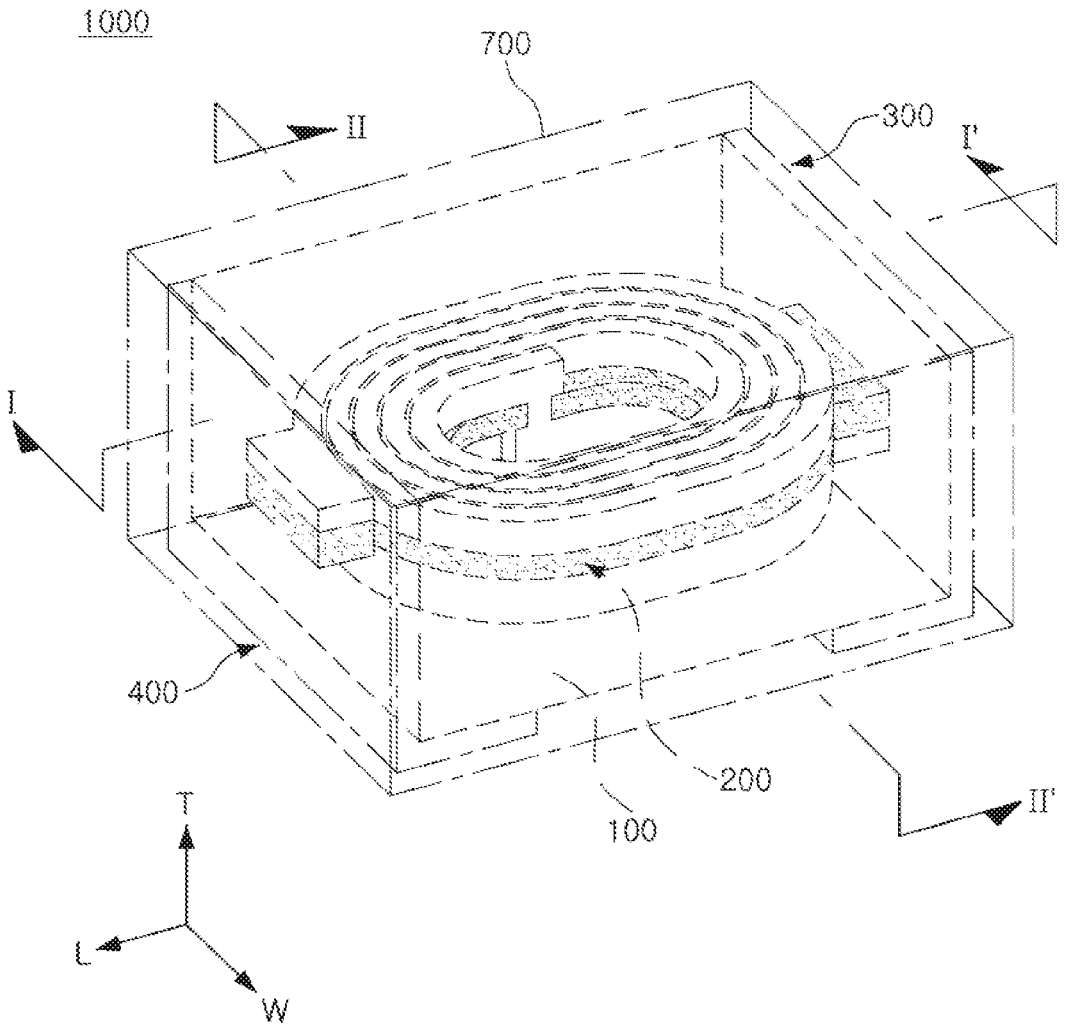
FIG. 1 is a perspective view schematically illustrating a coil component according to a first exemplary embodiment in the present disclosure.

Hereinafter, exemplary embodiments of the present disclosure will now be described in detail with reference to the accompanying drawings. In the accompanying drawings, shapes, sizes, and the like, of components may be exaggerated or stylized for clarity.

The present disclosure may, however, be exemplified in many different forms and should not be construed as being limited to the specific embodiments set forth herein. Rather these embodiments are provided so that this disclosure will be thorough and complete, and will fully convey the scope of the disclosure to those skilled in the art.

The term "an exemplary embodiment" used herein does not refer to the same exemplary embodiment, and is provided to emphasize a particular feature or characteristic different from that of another exemplary embodiment. However, exemplary embodiments provided herein are considered to be able to be implemented by being combined in whole or in part one with another. For example, one element described in a particular exemplary embodiment, even if it is not described in another exemplary embodiment, may be understood as a description related to another exemplary embodiment, unless an opposite or contradictory description is provided therein.

The meaning of a "connection" of a component to another component in the description includes an indirect connection through a third component as well as a direct connection between two components. In addition, "electrically connected" means the concept including a physical connection and a physical disconnection. It can be understood that when an element is referred to with "first" and "second", the element is not limited thereby. They may be used only for a purpose of distinguishing the element from the other elements, and may not limit the sequence or importance of the elements. In some cases, a first element may be referred to as a second element without departing from the scope of the claims set forth herein. Similarly, a second element may also be referred to as a first element.

Herein, an upper portion, a lower portion, an upper side, a lower side, an upper surface, a lower surface, and the like, are decided in the accompanying drawings. For example, a first component is disposed on a level above a layer. However, the claims are not limited thereto. In addition, a vertical direction refers to the abovementioned upward and downward directions, and a horizontal direction refers to a direction perpendicular to the abovementioned upward and downward directions. In this case, a vertical cross section refers to a case taken along a plane in the vertical direction, and an example thereof may be a cross-sectional view illustrated in the drawings. In addition, a horizontal cross section refers to a case taken along a plane in the horizontal direction, and an example thereof may be a plan view illustrated in the drawings.

Terms used herein are used only in order to describe an exemplary embodiment rather than limiting the present disclosure. In this case, singular forms include plural forms unless interpreted otherwise in context.

In the drawings, a first direction and a length direction may be defined as a direction L, a second direction or a width direction may be defined as a direction W, and a third direction or a thickness direction may be defined as a direction T.

Hereinafter, a coil component and a method of manufacturing the same according to exemplary embodiments in the present disclosure will be described in detail with reference to the accompanying drawings. In description with reference to the accompanying drawings, the same or corresponding elements are denoted by the same reference numerals, and a redundant description thereof will be omitted.

In an electronic device, various types of electronic components may be used. Various types of coil components may be properly used for the purpose of removing noise between the above electronic components.

In other words, a coil component in an electronic device may be used as a power inductor, a high-frequency (HF) inductor, a general bead, a bead for high frequency (GHz bead), a common mode filter, and the like.

First Exemplary Embodiment

Figure 2A:
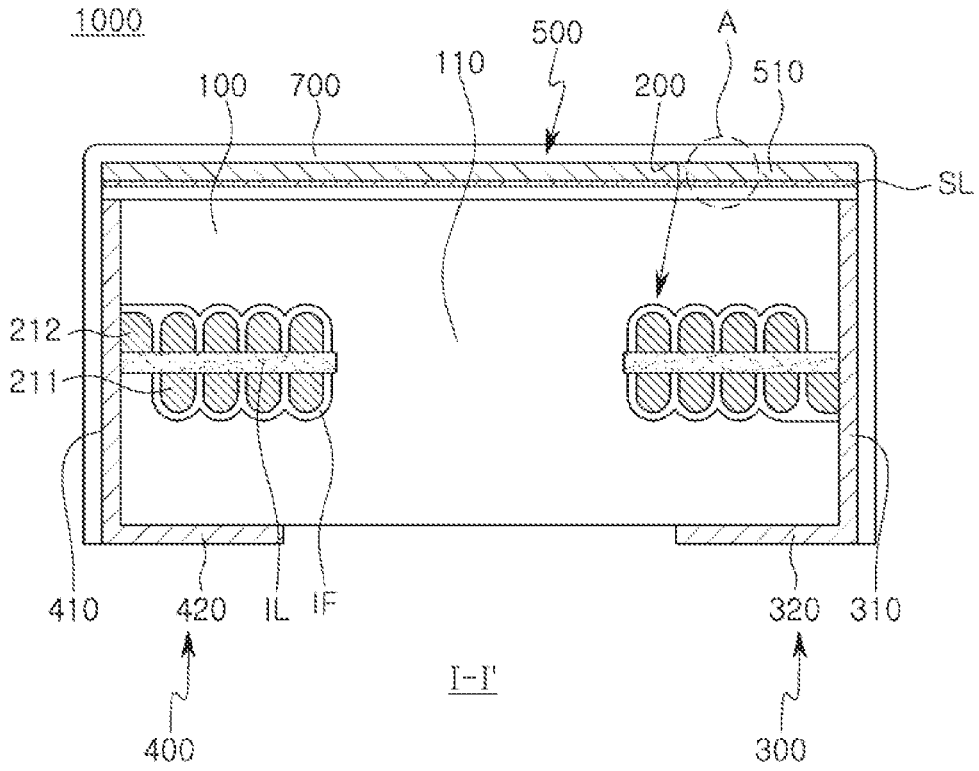
FIG. 2A is a cross-sectional view taken along line I-I' of FIG. 1.
Figure 2B:
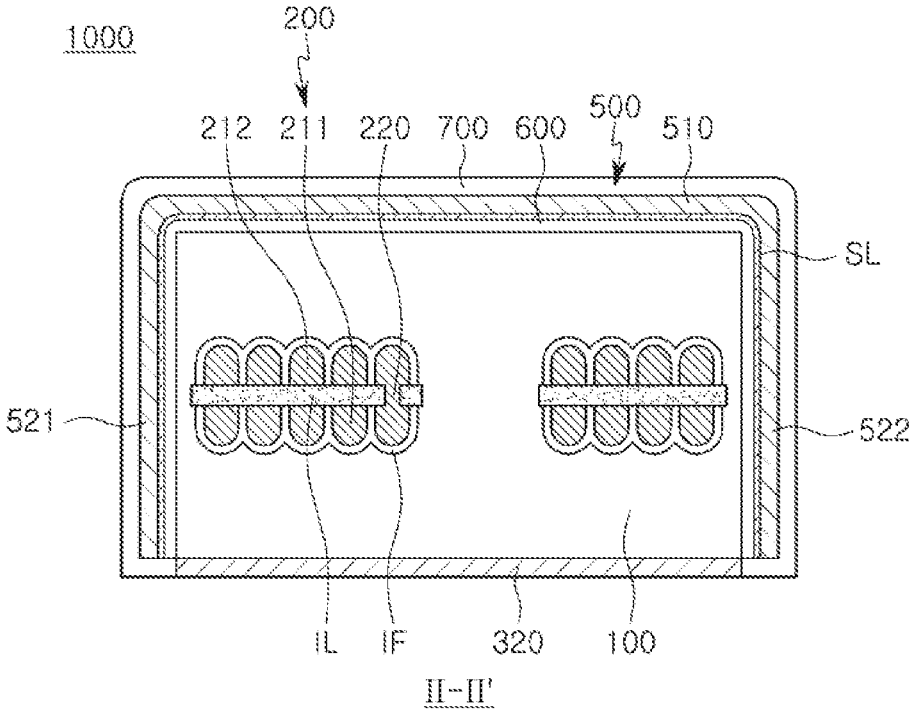
FIG. 2B is a cross-sectional view taken along line II-II' of FIG. 1, and FIGS. 2C, 2D and 2E are enlarged views of area A of FIG. 2A.

FIG. 1 is a perspective view schematically illustrating a coil component according to a first exemplary embodiment in the present disclosure. FIG. 2A is a cross-sectional view taken along line I-I' of FIG. 1, FIG. 2B is a cross-sectional view taken along line II-II' of FIG. 1, and FIGS. 2C, 2D and 2E are enlarged views of area A of FIG. 2A.

Referring to FIGS. 1 and 2A through 2E, a coil component 1000 according to the first exemplary embodiment in the present disclosure may include a body 100, a coil part 200, external electrodes 300 and 400, a shielding layer 500, an insulating layer 600 and a seed layer SL, and may further include a cover layer 700, an internal insulating layer IL and an insulating film IF.

The body 100 may form an external appearance of the coil component 1000 according to the present exemplary embodiment, and the coil part 200 may be embedded in the body 100.

The body 100 may be formed to have a hexahedral shape as a whole.

Hereinafter, as an example, the first exemplary embodiment will be described on the assumption that the body 100 has a hexahedral shape. However, the above description does not exclude a coil component including a body formed with a shape other than the hexahedral shape from the scope of the present exemplary embodiment.

The body 100 may include a first surface and a second surface that oppose each other in the length direction L, a third surface and a fourth surface that oppose each other in the width direction W, and a fifth surface and a sixth surface that oppose each other in the thickness direction T. The first through fourth surfaces of the body 100 may correspond to wall surfaces of the body 100 to connect the fifth surface and the sixth surface of the body 100. The wall surfaces of the body 100 may include the first surface and the second surface that are both end surfaces opposing each other, and the third surface and the fourth surface that are both side surfaces opposing each other.

As an example, the body 100 may be formed so that the coil component 1000 according to the present exemplary embodiment including the external electrodes 300 and 400, the insulating layer 600, the shielding layer 500 and the cover layer 700 to be described below may have, for example, a length of 2.0 mm, a width of 1.2 mm and a thickness of 0.65 mm, however, there is no limitation thereto.

The body 100 may include a magnetic material and a resin. Specifically, the body 100 may be formed by stacking one or more magnetic composite sheets in which a magnetic material is dispersed in a resin. However, the body 100 may also have structures other than a structure in which a magnetic material is dispersed in a resin. For example, the body 100 may be formed of a magnetic material, such as a ferrite.

A magnetic material may be a ferrite or a magnetic metal powder.

The ferrite may include, for example, at least one of a spinel-type ferrite, such as an Mg—Zn-based ferrite, an Mn—Zn-based ferrite, an Mn—Mg-based ferrite, a Cu—Zn-based ferrite, an Mg—Mn—Sr-based ferrite, a Ni—Zn-based ferrite, and the like, a hexagonal ferrite, such as a Ba—Zn-based ferrite, a Ba—Mg-based ferrite, a Ba—Ni-based ferrite, a Ba—Co-based ferrite, a Ba—Ni—Co-based ferrite, and the like, a garnet-type ferrite, such as a Y-based ferrite, and the like, and an Li-based ferrite.

The magnetic metal powder may include one or more selected from the group consisting of iron (Fe), silicon (Si), chromium (Cr), cobalt (Co), molybdenum (Mo), aluminum (Al), niobium (Nb), copper (Cu), and nickel (Ni). For example, the magnetic metal powder may be at least one of a pure iron powder, an Fe—Si-based alloy powder, an Fe—Si—Al-based alloy powder, an Fe—Ni-based alloy powder, an Fe—Ni—Mo-based alloy powder, an Fe—Ni—Mo—Cu-based alloy powder, an Fe—Co-based alloy powder, an Fe—Ni—Co-based alloy powder, an Fe—Cr-based alloy powder, an Fe—Cr—Si-based alloy powder, an Fe—Si—Cu—Nb-based alloy powder, an Fe—Ni—Cr-based alloy powder, and an Fe—Cr—Al-based alloy powder.

The magnetic metal powder may be amorphous or crystalline. For example, the magnetic metal powder may be a Fe—Si—B—Cr-based amorphous alloy powder, but is not necessarily limited thereto.

Each of the ferrite and the magnetic metal powder may have an average diameter of about 0.1 μm to 30 μm, but is not limited thereto.

The body 100 may include two or more types of magnetic materials dispersed in the resin. Here, different types of magnetic materials may indicate that the magnetic materials dispersed in the resin are distinguished from each other based on one of an average particle diameter, a composition, crystallizability, and a shape.

The resin may include epoxy, polyimide, liquid-crystal polymer, and the like, alone or in combination, but is not limited thereto.

The body 100 may include a core 110 penetrating through the coil part 200 to be described below. The core 110 may be formed by filling a through hole of the coil part 200 with a magnetic composite sheet; however, exemplary embodiments are not limited thereto.

The coil part 200 may be embedded in the body 100, and may exhibit a characteristic of a coil component. For example, when the coil component 1000 is utilized as a power inductor, the coil part 200 may store an electric field as a magnetic field and may maintain an output voltage, to perform a function of stabilizing power of an electronic device.

The coil part 200 includes a first coil pattern 211, a second coil pattern 212, and a via 220.

The first coil pattern 211 and the second coil pattern 212, and the internal insulating layer IL to be described below may be sequentially stacked and formed in the thickness direction T of the body 100.

Each of the first coil pattern 211 and the second coil pattern 212 may be formed in a form of a flat spiral. As an example, the first coil pattern 211 may form at least one turn on one surface of the internal insulating layer IL in the thickness direction T of the body 100.

The via 220 may be in contact with each of the first coil pattern 211 and the second coil pattern 212 by penetrating through the internal insulating layer IL so that the first coil pattern 211 and the second coil pattern 212 may be electrically connected. As a result, the coil part 200 applied to the present exemplary embodiment may be formed as a single coil that generates a magnetic field in the thickness direction T of the body 100.

At least one of the first coil pattern 211, the second coil pattern 212 and the via 220 may include at least one conductive layer.

As an example, when the second coil pattern 212 and the via 220 are formed by plating, each of the second coil pattern 212 and the via 220 may include an electroplating layer and an internal seed layer of an electroless plating layer. Here, the electroplating layer may have a monolayer structure or a multilayer structure. A multilayer structure of electroplating layers may be formed as a conformal film structure in which one electroplating layer is covered by another electroplating layer, or may be formed in a shape in which one electroplating layer is laminated on one surface of another electroplating layer. An internal seed layer of the second coil pattern 212 and an internal seed layer of the via 220 may be integrally formed and a boundary therebetween may not be formed, however, exemplary embodiments are not limited thereto. An electroplating layer of the second coil pattern 212 and an electroplating layer of the via 220 may be integrally formed and a boundary therebetween may not be formed, however, exemplary embodiments are not limited thereto.

In another example, when the first coil pattern 211 and the second coil pattern 211 are individually formed and collectively stacked on the internal insulating layer IL to form the coil part 200, the via 220 may include a high-melting point metal layer, and a low-melting point metal layer that has a lower melting point than that of the high-melting point metal layer. Here, the low-melting point metal layer may be formed by a solder with lead (Pb) and/or tin (Sn). At least a portion of the low-melting point metal layer may be melted due to a pressure and a temperature during collective stacking, and an intermetallic compound (IMC) layer may be formed at a boundary between the low-melting point metal layer and the second coil pattern 212.

As an example, the first coil pattern 211 and the second coil pattern 212 may protrude from a lower surface and an upper surface of the internal insulating layer IL, respectively. In another example, the first coil pattern 211 may be embedded on the lower surface of the internal insulating layer IL so that a lower surface may be exposed to the lower surface of the internal insulating layer IL, and the second coil pattern 212 may protrude from the upper surface of the internal insulating layer IL. In this example, a concave portion may be formed on the lower surface of the first coil pattern 211, and accordingly the lower surface of the internal insulating layer IL and the lower surface of the first coil pattern 211 may not be located on the same plane. In still another example, the first coil pattern 211 may be embedded on the lower surface of the internal insulating layer IL so that the lower surface may be exposed to the lower surface of the internal insulating layer IL, and the second coil pattern 212 may be embedded on the upper surface of the internal insulating layer IL so that an upper surface may be exposed to the upper surface of the internal insulating layer IL.

An end portion of each of the first coil pattern 211 and the second coil pattern 212 may be exposed to the first surface and the second surface of the body 100. An end portion of the first coil pattern 211 exposed to the first surface of the body 100 may be in contact with a first external electrode 300 to be described below, so that the first coil pattern 211 may be electrically connected to the first external electrode 300. An end portion of the second coil pattern 212 exposed to the second surface of the body 100 may be in contact with a second external electrode 400 to be described below, so that the second coil pattern 212 may be electrically connected to the second external electrode 400.

Each of the first coil pattern 211, the second coil pattern 211 and the via 220 may be formed of a conductive material, such as copper (Cu), aluminum (Al), silver (Ag), tin (Sn), gold (Au), nickel (Ni), lead (Pb), titanium (Ti), alloys thereof, and the like, however, exemplary embodiments are not limited thereto.

The internal insulating layer IL may be formed of an insulating material including a thermosetting insulating resin, such as an epoxy resin, a thermoplastic insulating resin, such as polyimide, or a photosensitive insulating resin, or be formed of an insulating material with the above insulating resin in which a reinforcement material, such as a glass fiber or an inorganic filler, is impregnated. As an example, the internal insulating layer IL may be formed of an insulating material, such as a prepreg, an ajinomoto build-up film (ABF), FR-4, a bismaleimide triazine (BT) resin, a photoimageable dielectric (PID), and the like, however, exemplary embodiments are not limited thereto.

As an inorganic filler, at least one selected from the group consisting of silica ($SiO_2$), alumina ($Al_2O_3$), silicon carbide (SiC), barium sulfate ($BaSO_4$), talc, mud, mica powder, aluminum hydroxide ($AlOH_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$) and calcium zirconate ($CaZrO_3$) may be used.

When the internal insulating layer IL is formed of an insulating material including a reinforcement material, the internal insulating layer IL may provide more excellent rigidity. When the internal insulating layer IL is formed of an insulating material that does not include a glass fiber, the internal insulating layer IL may be effectively used to reduce the overall thickness of the coil part 200. When the internal insulating layer IL is formed of an insulating material including a photosensitive insulating resin, it may be effective to reduce a production cost by reducing the number of processes, and fine hole processing is possible.

The insulating film IF may be formed along a surface of the first coil pattern 211, the internal insulating layer IL and the second coil pattern 212. The insulating film IF may be used to protect and insulate each of the first and the second coil patterns 211 and 212, and may include a known insulating material, such as parylene, and the like. Any insulating material may be included in the insulating film IF, and is not particularly limited. The insulating film IF may be formed by a method such as a vapor deposition, and the like, however, exemplary embodiments are not limited thereto. The insulating film IF may be formed by stacking insulating films on both surfaces of the internal insulating layer IL on which the first and the second coil patterns 211 and 212 are formed.

Meanwhile, although not shown in the drawings, a plurality of first coil patterns 211 and/or a plurality of second coil patterns 212 may be formed. For example, the coil part 200 may have a structure in which a plurality of first coil patterns 211 are formed so that another first coil pattern is stacked on a lower surface of one first coil pattern. In this example, an additional insulating layer may be disposed between the plurality of first coil patterns 211, however, exemplary embodiments are not limited thereto.

The external electrodes 300 and 400 may be disposed on one surface of the body 100 and connected to the first and the second coil patterns 211 and 212. The external electrodes 300 and 400 may include a first external electrode 300 connected to the first coil pattern 211 and a second external electrode 400 connected to the second coil pattern 212. Specifically, the first external electrode 300 may include a first connection part 310 that is disposed on the first surface of the body 100 and that is connected to an end portion of the first coil pattern 211, and a first extension part 320 that extends from the first connection part 310 to the sixth surface of the body 100. The second external electrode 400 may include a second connection part 410 that is disposed on the second surface of the body 100 and that is connected to an end portion of the second coil pattern 212, and a second extension part 420 that extends from the second connection part 410 to the sixth surface of the body 100. The first extension part 320 and the second extension part 420 may be spaced apart from each other on the sixth surface of the body 100 so that the first external electrode 300 and the second external electrode 400 may not be in contact with each other.

The external electrodes 300 and 400 may electrically connect the coil component 1000 according to the present exemplary embodiment to a printed circuit board (PCB), and the like, when the coil component 1000 is mounted in the PCB, and the like. As an example, the coil component 1000 according to the present exemplary embodiment may be mounted so that the sixth surface of the body 100 may face an upper surface of the PCB, and the extension parts 320 and 420 of the external electrodes 300 and 400 disposed on the sixth surface of the body 100 may be electrically connected to a connecting part of the PCB by a solder, and the like.

The external electrodes 300 and 400 may each include a conductive resin layer, and a conductive layer formed on the conductive resin layer. The conductive resin layer may be formed by paste printing, and the like, and may include any one or more conductive metals selected from the group consisting of copper (Cu), nickel (Ni) and silver (Ag), and a thermosetting resin. The conductive layer may include any one or more selected from the group consisting of nickel (Ni), copper (Cu) and tin (Sn), and may be formed by, for example, plating.

As an example, the connection parts 310 and 410 and the extension parts 320 and 420 may be integrally formed by the same electro-copper plating process, however, exemplary embodiments are not limited thereto.

The insulating layer 600 may be disposed on all surfaces of the body 100 except the first, second and sixth surfaces of the body 100, and may electrically separate the shielding layer 500 to be described below from the body 100 and the external electrodes 300 and 400. In other words, the insulating layer 600 may be disposed on the third, fourth and fifth surfaces of the body 100.

The insulating layer 600 may include a thermoplastic resin, such as polystyrene-based, vinyl acetate-based, polyester-based, polyethylene-based, polypropylene-based, polyamide-based, rubber-based, acrylic-based, and the like, a thermosetting resin, such as phenol-based, epoxy-based, urethane-based, melamine-based, alkyd-based, and the like, a photosensitive resin, parylene, SiOx or SiNx.

The insulating layer 600 may be formed by applying a liquid insulating resin to the body 100, by stacking an insulating film, such as a dry film (DF), on the body 100, or by forming an insulating resin on a surface of the body 100 by a vapor deposition. As an insulating film, a polyimide film, an ajinomoto build-up film (ABF) that does not include a photosensitive insulating resin, and the like, may be used.

The insulating layer 600 may be formed to have a thickness of 10 nm to 100 μm. When the thickness of the insulating layer 600 is less than 10 nm, a characteristic of a coil component, such as a Q factor, and the like, may be reduced. When the thickness of the insulating layer 600 is greater than 100 μm, a total length, a total width and an overall thickness of the coil component may increase, which may be unfavorable for implementing a thin product.

The seed layer SL may be formed between the insulating layer 600 and the shielding layer 500 to be described below. In the present exemplary embodiment, the shielding layer 500 to be described below may include a cap part 510 disposed on the fifth surface of the body 100, and a first side wall part 521 and a second side wall part 522 that are formed on both sides of the body 100, that is, the third surface and the fourth surface of the body 100, respectively, and accordingly the seed layer SL may be formed on the third, fourth and fifth surfaces of the body 100.

The seed layer SL may be formed by electroless plating, or a vapor deposition, such as sputtering, and the like. In the former case, the seed layer SL may be an electroless copper plating layer, but is not limited thereto. In the latter case, the seed layer SL may include at least one of copper (Cu), gold (Au), platinum (Pt), molybdenum (Mo), titanium (Ti) and chromium (Cr), and the seed layer SL may include, for example, a titanium layer and a chromium layer formed on the titanium layer, however, exemplary embodiments are not limited thereto. When the seed layer SL includes at least one of titanium (Ti) and chromium (Cr), the seed layer SL may enhance an adhesion between the insulating layer 600 and the shielding layer 500 to be described below.

Figure 2C:
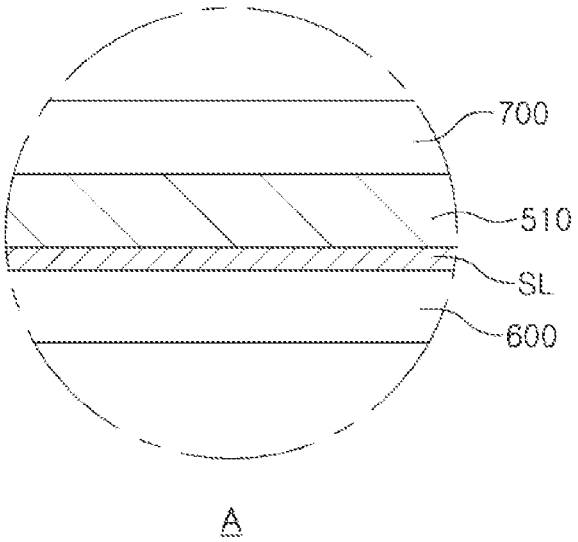

Referring to FIG. 2C, the seed layer SL may be formed with a relatively uniform film thickness on the insulating layer 600. Here, the fact that the seed layer SL formed with the relatively uniform film thickness may indicate that a thickness distribution of the seed layer SL is relatively constant in comparison to a seed layer SL of FIG. 2D. Thus, when a roughness is formed on an upper surface of the insulating layer 600, the seed layer SL may be formed with a uniform film thickness based on a shape of the upper surface of the insulating layer 600 so that a roughness corresponding to the roughness of the upper surface of the insulating layer 600 may be formed on an upper surface of the seed layer SL.

Figure 2D:
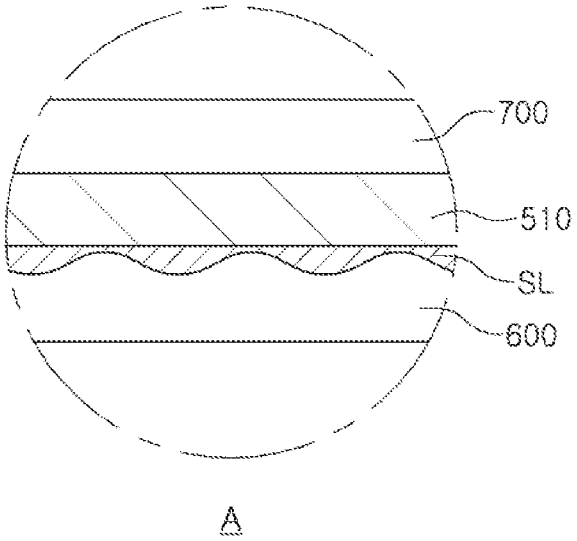
Figure 2E:
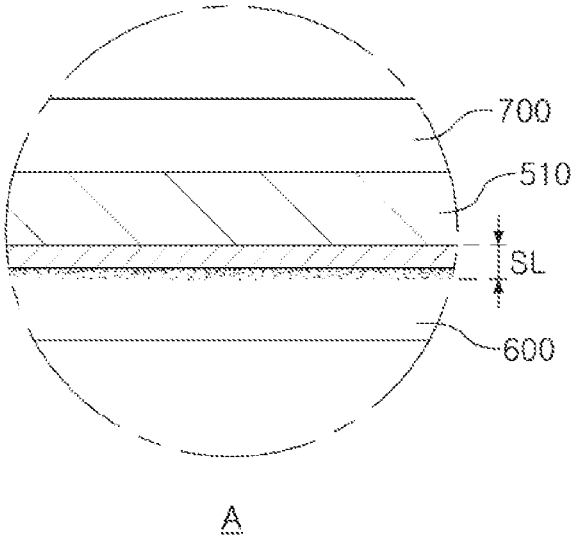

Referring to FIGS. 2D and 2E, at least a portion of the seed layer SL may penetrate into the insulating layer 600. As an example, as shown in FIG. 2D, the seed layer SL may be formed with a non-uniform film thickness on the insulating layer 600. Since a degree of penetration of the seed layer SL varies depending on a region of the insulating layer 600, the roughness may be formed at an interface between the insulating layer 600 and the seed layer SL. In another example, as shown in FIG. 2E, particles forming the seed layer SL may penetrate into the insulating layer 600, and the seed layer SL may include a mixed layer in which an insulating resin of the insulating layer 600 and the particles of the seed layer SL are mixed.

As an example of forming the seed layer SL of FIG. 2C, electroless plating or a vapor deposition, such as sputtering, and the like, may be used. As examples of forming the seed layers SL of FIGS. 2D and 2E, a specific type of a vapor deposition method of accelerating particles for forming a vaporized seed layer towards the insulating layer 600 using additional energy may be used, but is not limited thereto.

The shielding layer 500 may be formed on the seed layer SL, and may be disposed on the third, fourth and fifth surfaces of the body 100, to reduce leakage flux leaking out from the coil component 1000 according to the present exemplary embodiment The shielding layer 500 may be formed to have a thickness of 10 nm to 100 μm. When the thickness of the shielding layer 500 is less than 10 nm, there may be little EMI shielding effect. When the thickness of the shielding layer 500 is greater than 100 μm, the total length, the total width and the overall thickness of the coil component may increase, which may be unfavorable for implementing a thin product.

In the present exemplary embodiment, the shielding layer 500 may include the cap part 510 disposed on the fifth surface of the body 100, and first and second side wall parts 521 and 522 disposed on both sides of the body 100, that is, on the third and fourth surfaces of the body 100, respectively.

The cap part 510 and the first and second side wall parts 521 and 522 may be integrally formed. In other words, the cap part 510 and the first and second side wall parts 521 and 522 may be formed by the same process so that a boundary therebetween may not be formed. As an example, the cap part 510 and the first and second side wall parts 521 and 522 may be integrally formed by performing a vapor deposition, such as sputtering, on the body 100 on which the seed layer SL is formed. In another example, the cap part 510 and the first and second side wall parts 521 and 522 may be integrally formed by performing electroplating on the body 100 on which the seed layer SL is formed.

The cap part 510 and the first and second side wall parts 521 and 522 may be connected to form a curved surface. As an example, when the shielding layer 500 is formed by a vapor deposition, such as sputtering, a cross section of a region in which the cap part 510 and the first and second side wall parts 521 and 522 are connected may be formed as a curved surface. In another example, when the shielding layer 500 is formed by electroplating, a cross section of a region in which the cap part 510 and the first and second side wall parts 521 and 522 are connected may be formed as a curved surface.

Each of the first and second side wall parts 521 and 522 may include one end connected to the cap part 510 and another end opposing the one end, and a distance from the sixth surface of the body 100 to another end of one of the first and second side wall parts 521 and 522 may be different from a distance from the sixth surface of the body 100 to another end of the other of the first and second side wall parts 521 and 522. As an example, when the shielding layer 500 is formed by electroplating or a vapor deposition, distances from the sixth surface of the body 100 to the other ends of the first and second side wall parts 521 and 522 may be different from each other depending on tolerance or design needs.

The shielding layer 500 may include at least one of a conductor and a magnetic body. As an example, the conductor may be a metal including one or more selected from the group consisting of copper (Cu), silver (Ag), gold (Au), aluminum (Al), iron (Fe), silicon (Si), boron (B), chromium (Cr), niobium (Nb) and nickel (Ni), or alloys thereof, and may be Fe—Si or Fe—Ni. Also, the shielding layer 500 may include one or more selected from the group consisting of a ferrite, permalloy, and an amorphous ribbon. The shielding layer 500 may be, for example, a copper-plating layer, but is not limited thereto. The shielding layer 500 may have a multilayer structure, and may be formed with, for example, a double-layer structure of a conductor layer and a magnetic body layer formed on the conductor layer, a double-layer structure of a first conductor layer and a second conductor layer formed on the first conductor layer, or a structure of a plurality of conductor layers. Here, the first and the second conductor layers may include different conductors, or the same conductors.

The shielding layer 500 may include two or more microstructures separated from each other. As an example, when each of the cap part 510 and the side wall parts 521 and 522 is formed by sputtering, each of the cap part 510 and the side wall parts 521 and 522 may include a plurality of microstructures that are divided by grain boundaries.

The cover layer 700 may cover the shielding layer 500. In other words, the shielding layer 500 together with the insulating layer 600 may be embedded in the cover layer 700. In the present exemplary embodiment, the cover layer 700 may be disposed on the first through fifth surfaces of the body 100, and may be formed to be in contact with the insulating layer 600 by covering another end of each of the first and second side wall parts 521 and 522. The cover layer 700 may prevent an electrical connection between the side wall parts 521 and 522 and the external electrodes 300 and 400 by covering another end of each of the side wall parts 521 and 522. In addition, the cover layer 700 may prevent the shielding layer 500 from being electrically connected to another external electronic component.

The cover layer 700 may include at least one of a thermoplastic resin, such as polystyrene-based, vinyl acetate-based, polyester-based, polyethylene-based, polypropylene-based, polyamide-based, rubber-based, acrylic-based, and the like, a thermosetting resin, such as phenol-based, epoxy-based, urethane-based, melamine-based, alkyd-based-based, and the like, a phtosensitive insulating resin, parylene, SiOx or SiNx.

The cover layer 700 may be formed by stacking a cover film, such as a dry film (DF), on the body 100 on which the shielding layer 500 is formed. Alternatively, the cover layer 700 may be formed by forming an insulating material on the body 100 on which the shielding layer 500 is formed, by a vapor deposition, such as a chemical vapor deposition (CVD), and the like.

The cover layer 700 may have an adhesion function. As an example, when a cover film is stacked on the body 100 to form the cover layer 700, the cover layer 700 may include an adhesive ingredient to adhere to the shielding layer 500.

The cover layer 700 may be formed to have a thickness of 10 nm to 100 μm. When the thickness of the cover layer 700 is less than 10 nm, a short-circuit with an external electrode may occur due to weak insulating characteristics. When the thickness of the cover layer 700 is greater than 100 μm, the total length, the total width and the overall thickness of the coil component may increase, which may be unfavorable for implementing a thin product.

The total thickness of the insulating layer 600, the shielding layer 500 and the cover layer 700 may be greater than 30 nm and less than or equal to 100 μm. When the thickness sum of the insulating layer 600, the shielding layer 500 and the cover layer 700 is less than 30 nm, an electric short problem and a problem of a reduction in characteristics of a coil component such as a Q factor may occur. When the thickness sum of the insulating layer 600, the shielding layer 500 and the cover layer 700 is greater than 100 μm, the total length, the total width and the overall thickness of the coil component may increase, which may be unfavorable for implementing a thin product.

Meanwhile, although not shown in FIGS. 1 and 2E, an additional insulating layer distinguished from the insulating layer 600 may be formed on a region of the body 100 in which the external electrodes 300 and 400 are not formed. In other words, an additional insulating layer may be formed on regions of the sixth surface of the body 100 in which the external electrodes 300 and 400 are not formed. An additional insulating layer may function as a plating resist when the external electrodes 300 and 400 are formed by plating; however, exemplary embodiments are not limited thereto.

Since the insulating layer 600 and the cover layer 700 of the present disclosure are disposed on the coil component itself, the insulating layer 600 and the cover layer 700 may be distinguished from a molding material used to mold the coil component and a PCB in a step of mounting the coil component on the PCB. As an example, unlike the molding material, the insulating layer 600 and the cover layer 700 of the present disclosure may define a formation region even though the PCB does not exist. Thus, the insulating layer 600 of the present disclosure may not be in contact with the PCB. In addition, the insulating layer 600 and the cover layer 700 may not be supported or fixed by the PCB, unlike the molding material. Moreover, the molding material surrounds a connection member, such as a solder ball, that connects the coil component and the PCB, however, the insulating layer 600 and the cover layer 700 of the present disclosure may not be formed in a form to surround the connection member. Furthermore, since the insulating layer 600 of the present disclosure is not a molding material formed by heating an epoxy molding compound (EMC), and the like, allowing the EMC to flow onto the PCB and hardening the EMC, it is not necessary to consider the occurrence of voids during the formation of a molding material, and warpage of the PCB due to a difference in a thermal expansion coefficients between the molding material and the PCB.

In addition, since the shielding layer 500 of the present disclosure is disposed on the coil component itself, the shielding layer 500 may be distinguished from a sealed can coupled to the PCB for shielding an EMI, and the like, after the coil component is mounted on the PCB. As an example, unlike the sealed can, a connection of the shielding layer 500 of the present disclosure and a ground layer of the PCB may not be taken into consideration. In another example, the shielding layer 500 of the present disclosure may not require a fixing member to fix the sealed can to the PCB.

Since the shielding layer 500 is formed on the coil component itself, the coil component 1000 according to the present exemplary embodiment may more efficiently block leakage flux occurring in the coil component. In other words, when an electronic device becomes thinner and has higher performance, the total number of electronic components included in the electronic device and a distance between adjacent electronic components are decreasing. By shielding each coil component itself, leakage flux occurring in each coil component may be more efficiently blocked, which may be more effective in reducing a thickness and increasing performance of the electronic devices. In addition, since an amount of effective magnetic materials in a shielding region increases in comparison to a case of using a sealed can, the coil component 1000 according to the present exemplary embodiment may enhance a characteristic of the coil component.

Second Exemplary Embodiment

Figure 3A:
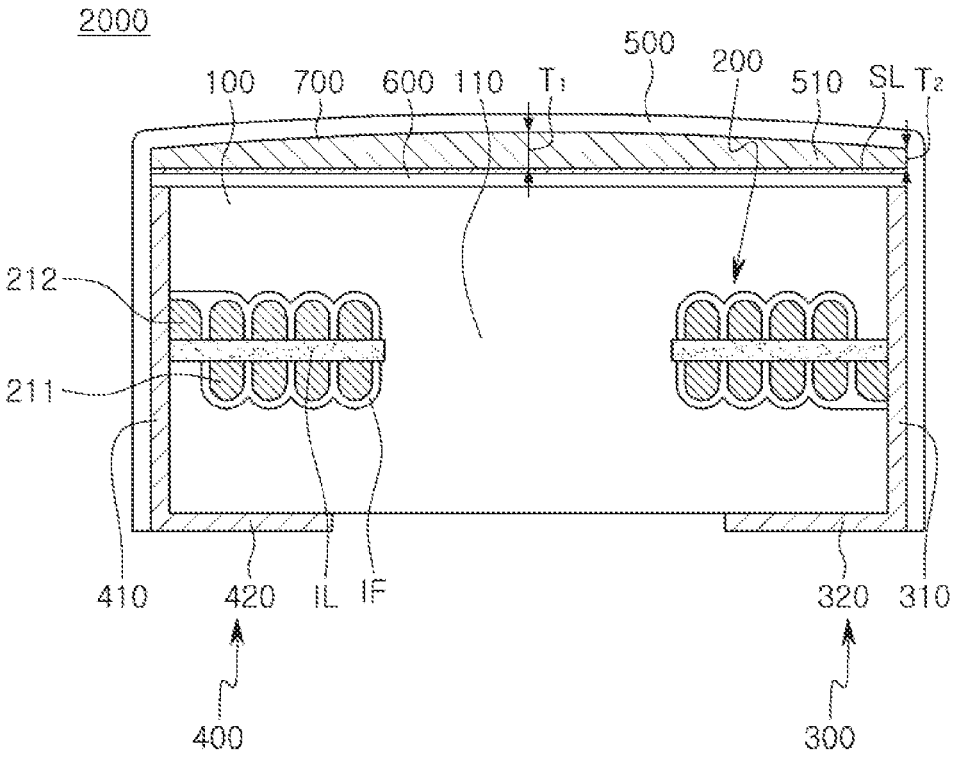
FIGS. 3A and 3B are cross-sectional views of a coil component according to a second exemplary embodiment in the present disclosure, taken along lines I-I' and II-II' of FIG. 1, respectively.
Figure 3B:
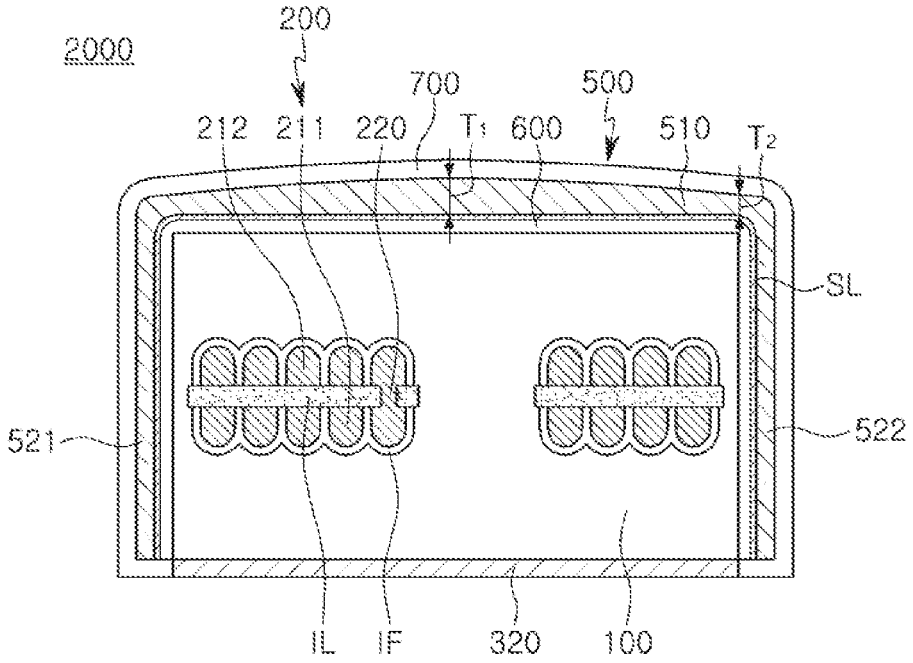

FIGS. 3A and 3B are cross-sectional views of a coil component according to a second exemplary embodiment in the present disclosure. FIG. 3A illustrates a cross section taken along line I-I' of FIG. 1, and FIG. 3B illustrates a cross section taken along line II-II' of FIG. 1.

Referring to FIGS. 1, 3A and 3B, a cap part 510 of a coil component 2000 according to the present exemplary embodiment may be different from that of the coil component 1000 according to the first exemplary embodiment in the present disclosure. Accordingly, in describing of the present exemplary embodiment, only the cap part 510 different from that of the first exemplary embodiment in the present disclosure will be described. The description of the first exemplary embodiment in the present disclosure may equally be applicable to the other configurations of the present exemplary embodiment.

Referring to FIGS. 3A and 3B, the cap part 510 may be formed so that a thickness T1 of a central portion may be greater than a thickness T2 of an outer portion, which will be described in detail.

Each of coil patterns 211 and 212 forming a coil part 200 of the present exemplary embodiment may form a plurality of turns from a central portion of an internal insulating layer IL to an outer portion of the internal insulating layer IL on both surfaces of the internal insulating layer IL. Each of the coil patterns 211 and 212 may be stacked in a thickness direction T of a body 100 and connected by a via 220. As a result, the coil component 2000 according to the present exemplary embodiment may have a highest magnetic flux density in a central portion of a length direction L—width direction W plane of the body 100 perpendicular to the thickness direction T of the body 100. Accordingly, in the present exemplary embodiment, when the cap part 510 disposed on a fifth surface of the body 100 that is substantially parallel to the length direction L—width direction W plane of the body 100 is formed, the thickness T1 of the central portion of the cap part 510 may be greater than the thickness T2 of the outer portion, in consideration of a distribution of a magnetic flux density on the length direction L—width direction W plane of the body 100.

Thus, the cap part 510 may be formed to have different thicknesses in correspondence to the distribution of the magnetic flux density, and accordingly the coil component 2000 according to the present exemplary embodiment may more efficiently reduce leakage flux.

Third Exemplary Embodiment

Figure 4:
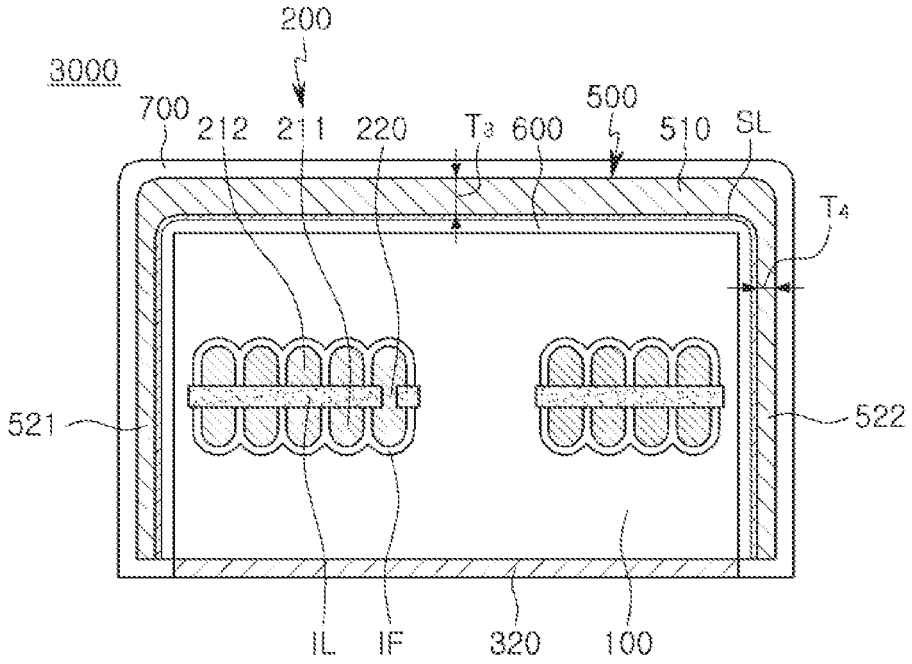
FIG. 4 is a cross-sectional view illustrating a coil component according to a third exemplary embodiment in the present disclosure, taken along line II-II' of FIG. 1.

FIG. 4 is a cross-sectional view illustrating a coil component according to a third exemplary embodiment in the present disclosure, taken along line II-II' of FIG. 1.

Referring to FIGS. 1 and 4, a cap part 510 and side wall parts 521 and 522 of a coil component 3000 according to the present exemplary embodiment are different from those of the coil components 1000 and 2000 according to the first and second exemplary embodiments in the present disclosure. Accordingly, in describing of the present exemplary embodiment, only the cap part 510 and the and side wall parts 521 and 522 different from those of the first and second exemplary embodiments in the present disclosure will be described. The description of the first or second exemplary embodiments in the present disclosure may equally be applicable to the other configurations of the present exemplary embodiment.

Referring to FIG. 4, a thickness T3 of the cap part 510 may be greater than a thickness T4 of each of the side wall parts 521 and 522.

As described above, a coil part 200 may generate a magnetic field in a thickness direction T of a body 100. As a result, magnetic flux leaking in the thickness direction T of the body 100 may be greater than magnetic flux leaking in the other directions. Thus, a thickness of the cap part 510 disposed on a fifth surface of the body 100 perpendicular to the thickness direction T of the body 100 may be formed to be greater than a thickness of each of side wall parts 521, 522, 523 and 524 disposed on wall surfaces of the body 100, and accordingly it is possible to more efficiently reduce leakage flux.

Thus, the coil component 3000 according to the present exemplary embodiment may efficiently reduce leakage flux in consideration of a direction of a magnetic field formed by the coil part 200.

Fourth Exemplary Embodiment

Figure 5:
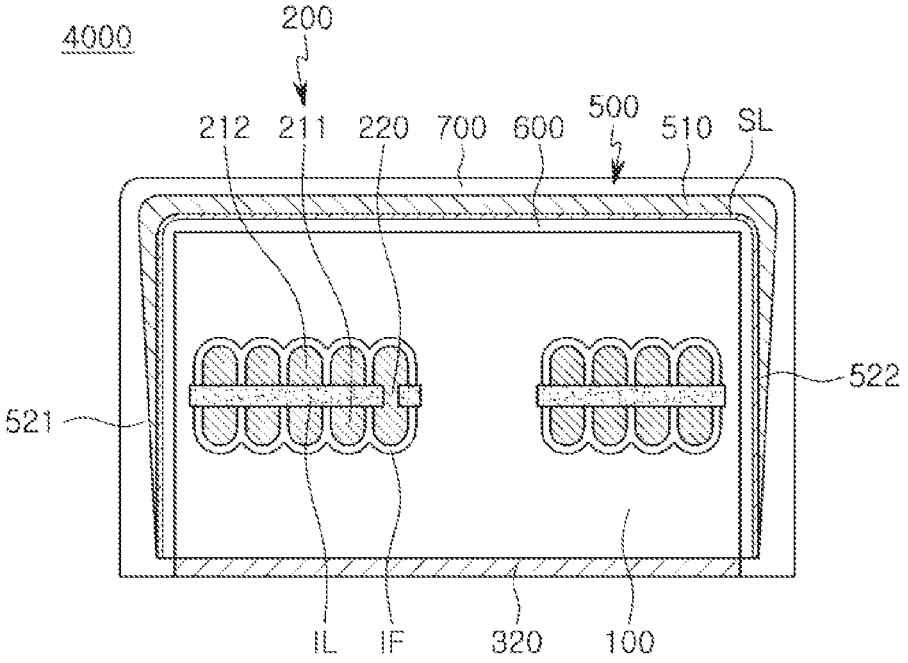
FIG. 5 is a cross-sectional view illustrating a coil component according to a fourth exemplary embodiment in the present disclosure, taken along line II-II' of FIG. 1.

FIG. 5 is a cross-sectional view illustrating a coil component according to a fourth exemplary embodiment in the present disclosure, taken along line II-II' of FIG. 1.

Referring to FIGS. 1 and 5, a cap part 510 and side wall parts 521 and 522 of a coil component 4000 according to the present exemplary embodiment are different from those of the coil components 1000, 2000 and 3000 according to the first through third exemplary embodiments in the present disclosure. Accordingly, in describing of the present exemplary embodiment, only the cap part 510 and the side wall parts 521 and 522 different from those of the first through third exemplary embodiments in the present disclosure will be described. The description of the first through third exemplary embodiments in the present disclosure may equally be applicable to the other configurations of the present exemplary embodiment.

Referring to FIG. 5, a thickness of one end of each of the side wall parts 521 and 522 may be greater than a thickness of another end of each of the side wall parts 521 and 522.

As an example, when the cap part 510 and the side wall parts 521 and 522 are formed by plating, a current density may be concentrated in an edge portion of a body 100 at which a fifth surface of the body 100 is connected to third and fourth surfaces of the body 100, that is, in a region in which one end of each of the side wall parts 521 and 522 is to be formed, due to a corner shape of the corresponding region. Accordingly, one end of each of the side wall parts 521 and 522 may be formed to have a relatively great thickness in comparison to another end of each of the side wall parts 521 and 522. In another example, after the body 100 is disposed so that the fifth surface of the body 100 opposes a target, sputtering may be performed to form a shielding layer 500, and accordingly one end of each of the side wall parts 521 and 522 may be formed to have a relatively great thickness in comparison to another end of each of the side wall parts 521 and 522. However, the scope of the present modification example is not limited to the above-described example.

Thus, the coil component 4000 according to the present embodiment may efficiently reduce leakage flux in consideration of a direction of a magnetic field formed by a coil part 200.

Fifth Exemplary Embodiment

Figure 6:
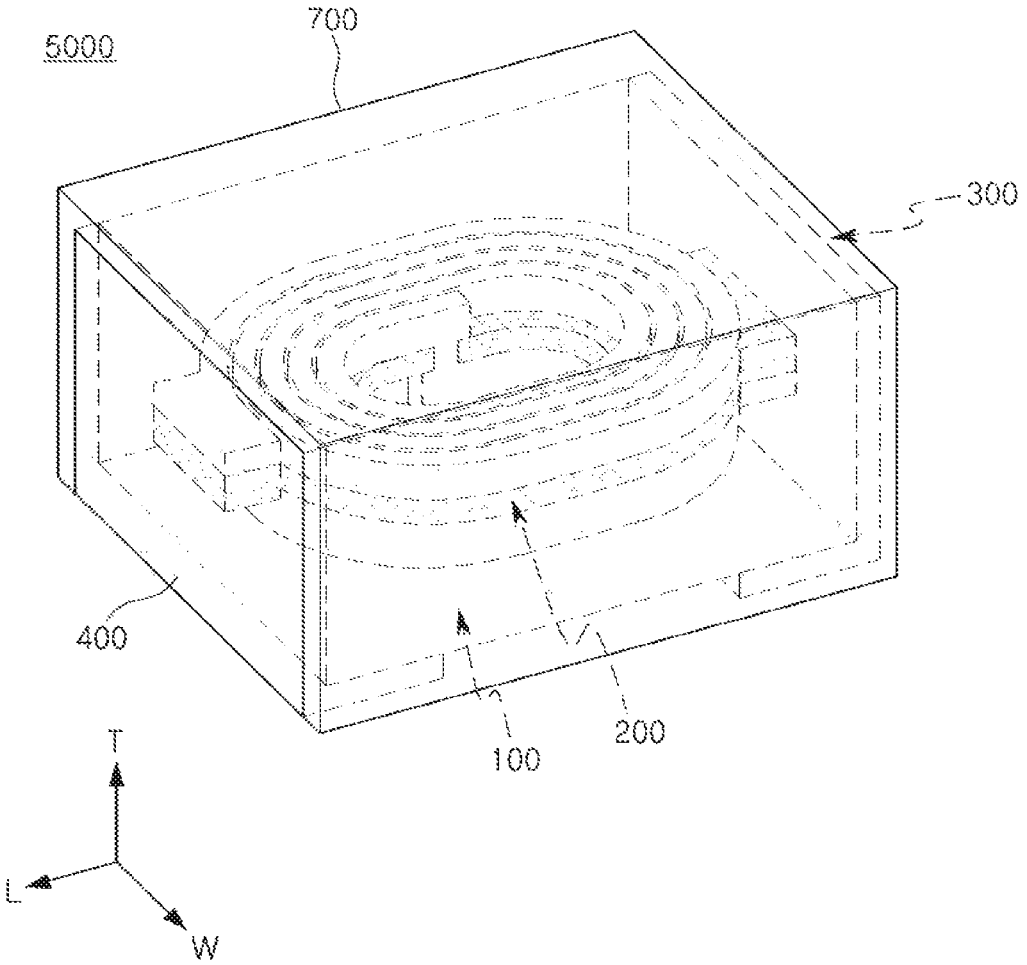
FIG. 6 is a perspective view schematically illustrating a coil component according to a fifth exemplary embodiment in the present disclosure.
Figure 7A:
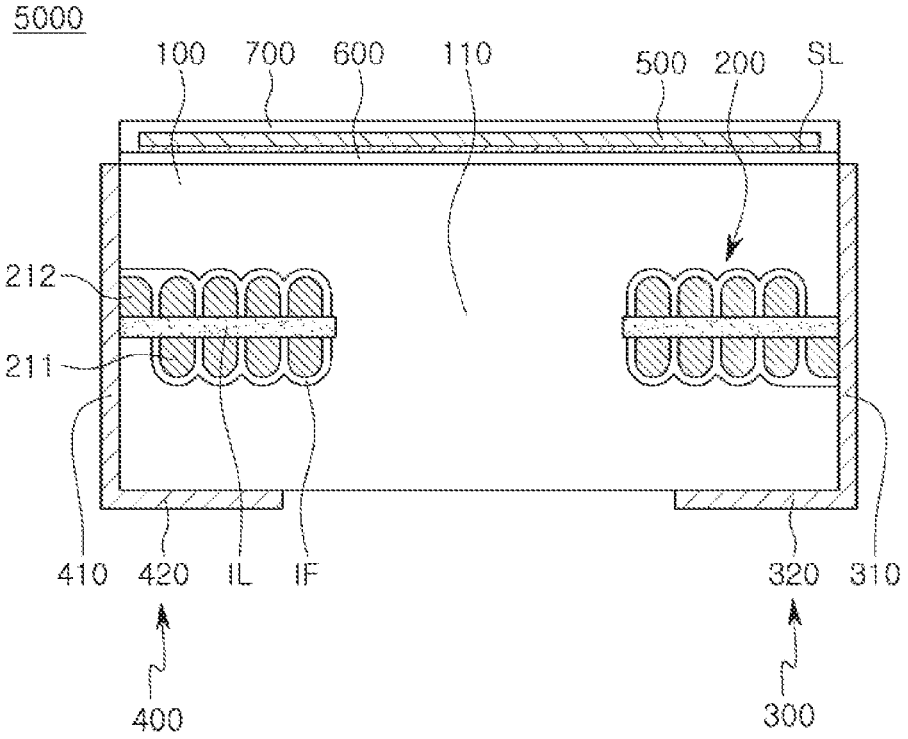
FIG. 7A is a cross-sectional view illustrating a L-T plane of FIG. 6.

FIG. 6 is a perspective view schematically illustrating a coil component according to a fifth exemplary embodiment in the present disclosure. FIG. 7A is a cross-sectional view illustrating an L-T plane of FIG. 6, and FIG. 7B is a cross-sectional view illustrating a W-T plane of FIG. 6.

Figure 7B:
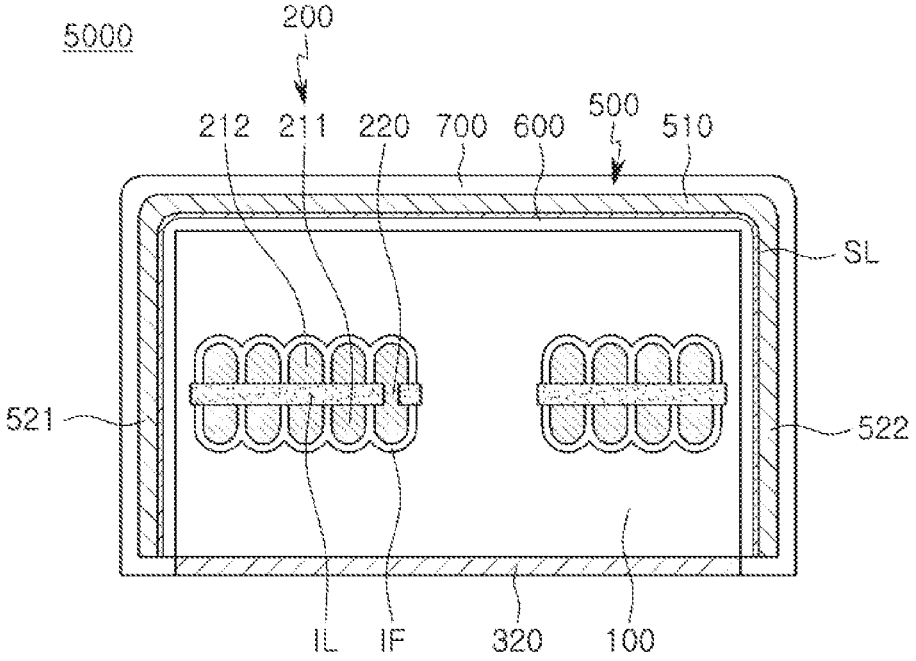
FIG. 7B is a cross-sectional view illustrating a W-T plane of FIG. 6.

Referring to FIGS. 6, 7A and 7B, a structure of a cover layer 700 of a coil component 5000 according to the present exemplary embodiment is different from those of the coil components 1000, 2000, 3000 and 4000 according to the first through fourth exemplary embodiments in the present disclosure. Accordingly, in describing of the present exemplary embodiment, only the cover layer 700 different from those of the first through fourth exemplary embodiments in the present disclosure will be described. The description of the first through fourth exemplary embodiments in the present disclosure may equally be applicable to the other configurations of the present exemplary embodiment.

Specifically, in the present exemplary embodiment, the cover layer 700 may be disposed on third through fifth surfaces of a body 100, instead of being disposed on first and second surfaces of the body 100.

In the present exemplary embodiment, a coil component may be manufactured by forming an insulating layer 600, a shielding layer 500 and the cover layer 700 in a coil bar state in which a plurality of coil parts are connected to each other, by forming a plurality of coil component precursors by cutting a coil bar so that a plurality of coil parts are separated, and by forming external electrodes 300 and 400 on both end surfaces to which an end surface of a coil part of the plurality of coil component precursors is exposed.

Specifically, first, a coil bar in which a plurality of coil parts are spaced apart from each other in a first direction and connected to each other by a connecting part are embedded may be formed. The coil bar may be formed by stacking a magnetic composite sheet on a coil substrate on which the plurality of coil parts are connected by the connecting part.

Next, an insulating layer, a shielding layer and a cover layer may be sequentially formed on all surfaces except a lower surface of the coil bar using a method, such as a vapor deposition, and the like.

Next, a plurality of coil component precursors may be manufactured by cutting the coil bar. Here, the coil bar may be cut so that the above-described connecting part may be removed. Accordingly, an end surface of a coil part of each of the plurality of coil component precursors may be exposed to both end surfaces of the body 100.

Next, external electrodes may be formed on both end surfaces of a coil component precursor. The external electrodes may be formed by an electroplating, however, exemplary embodiments are not limited thereto.

Thus, in the present exemplary embodiment, the insulating layer 600, the shielding layer 500 and the cover layer 700 may be formed in the coil bar state, and accordingly it is possible to reduce the number of processes and manufacturing time.

Sixth Exemplary Embodiment

Figure 8:
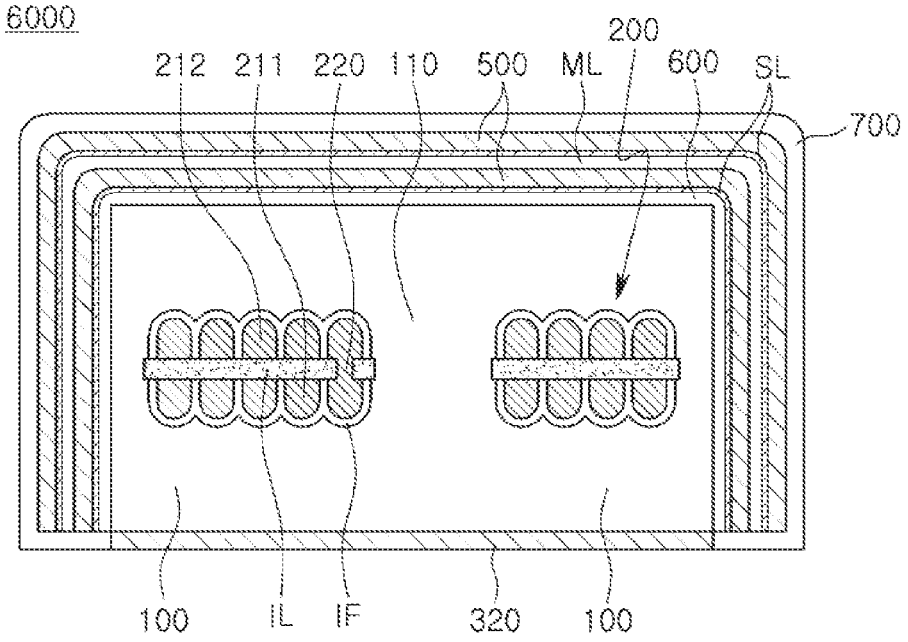
FIG. 8 is a cross-sectional view illustrating a coil component according to a sixth exemplary embodiment in the present disclosure, taken along line II-II' of FIG. 1.

FIG. 8 is a cross-sectional view illustrating a coil component according to a sixth exemplary embodiment in the present disclosure, and corresponds to a cross-sectional view taken along line II-II' of FIG. 1.

Referring to FIGS. 1 through 8, a structure of shielding layers 500 of a coil component 6000 according to the present exemplary embodiment is different from those of the coil components 1000, 2000, 3000, 4000 and 5000 according to the first through fifth exemplary embodiments in the present disclosure. Accordingly, in describing of the present exemplary embodiment, only the shielding layers 500 different from that of the first through fifth exemplary embodiments in the present disclosure will be described. The description of the first through fifth exemplary embodiments in the present disclosure may equally be applicable to the other configurations of the present exemplary embodiment.

Referring to FIG. 8, the shielding layers 500 applied to the present exemplary embodiment may be formed with a double-layer structure in which an intermediate insulating layer ML is interposed therebetween.

In the present exemplary embodiment, since the shielding layers 500 are formed with a double-layer structure, leakage flux passing through a first shielding layer 500 disposed relatively close to the body 100 may be shielded by a second shielding layer 500 relatively spaced from the body 100. Thus, the coil component 6000 according to the present exemplary embodiment may more efficiently block leakage flux. In addition, the intermediate insulating layer ML may function as a wave guide for noise reflected from the second shielding layer 500.

The description of the insulating layer 600 in the first through fourth exemplary embodiments in the present disclosure may equally be applicable to a material and a formation method of the intermediate insulating layer ML, and the like.

Meanwhile, in the above-described exemplary embodiments in the present disclosure, the external electrodes 300 and 400 applied to the present disclosure have been described on the assumption that the external electrodes 300 and 400 are L-shaped electrodes including connection parts 310 and 410 and extension parts 320 and 420, but this is only for convenience of description, and the external electrodes 300 and 400 may be modified in various forms. As an example, the external electrodes 300 and 400 may be formed on the sixth surface of the body 100, instead of on the first and the second surfaces of the body 100, and may be connected to the coil part 200 by a connection via, and the like.

As set forth above, according to the exemplary embodiment in the present disclosure, it is possible to reduce leakage flux of a coil component.

In addition, it is possible to substantially maintain a component characteristic while reducing leakage flux of a coil component.

While exemplary embodiments have been shown and described above, it will be apparent to those skilled in the art that modifications and variations could be made without departing from the scope of the present invention as defined by the appended claims.

What is claimed is:

1. A coil component comprising:

a body having a first surface and a second surface opposing each other in a first direction, and a plurality of wall surfaces connecting the first surface and the second surface to each other;

a coil part including a coil pattern embedded in the body, and forming at least one turn about the first direction;

first and second external electrodes connected to the coil part, formed, respectively, on two end surfaces opposing each other among the plurality of wall surfaces of the body, and extending to the first surface of the body;

a shielding layer including a cap part disposed on the second surface of the body, and a side wall part disposed on each of the plurality of wall surfaces of the body except the two end surfaces of the body;

an insulating layer formed between the body and the shielding layer; and a seed layer formed between the insulating layer and the shielding layer.

2. The coil component of claim 1, wherein at least a portion of the seed layer penetrates into the insulating layer.

3. The coil component of claim 1, wherein a thickness of the cap part is greater in a central portion of the second surface of the body than in an outer portion of the second surface of the body.

4. The coil component of claim 1, wherein a thickness of the cap part is greater than a thickness of the side wall part.

5. The coil component of claim 1, wherein a thickness of one end of the side wall part connected to the cap part is greater than a thickness of another end of the side wall part.

6. The coil component of claim 1, wherein the cap part and the side wall part are integrally formed.

7. The coil component of claim 1, wherein the shielding layer includes at least one of a conductor and a magnetic body.

8. The coil component of claim 1, further comprising:

a cover layer covering the shielding layer.

9. The coil component of claim 1, wherein the seed layer includes at least one of titanium (Ti), chromium (Cr) and copper (Cu).

10. The coil component of claim 1, further comprising:

an intermediate insulating layer, wherein the shielding layer includes a plurality of shielding layers, and wherein the intermediate insulating layer is disposed between adjacent shielding layers of the plurality of shielding layers.

11. A coil component comprising:

a coil part comprising a coil pattern having a spiral shape around an axis;

a body having a first surface and a second surface, each being perpendicular to the axis, the body encapsulating the coil;

first and second external electrodes connected respectively to first and second ends of the coil pattern, the first and second external electrodes disposed at least on the second surface of the body and spaced apart from each other;

an insulating layer disposed on the first surface of the body;

a shielding layer comprising a conducting cap part and an insulating cover part disposed on the insulating layer; and wherein the shielding layer further comprises a plurality of conducting cap parts and an intermediate insulating layer disposed alternately on the second surface of the body.

12. The coil component of claim 11, further comprising a seed layer disposed between the insulating layer and the conducting cap part, at least a portion of the seed layer penetrating the insulating layer.

13. The coil component of claim 11, wherein the body has at least two wall surfaces connecting the first and the second surfaces to each other, and the insulating layer, the seed layer and the shielding layer are further disposed on the at least two wall surfaces.

14. The coil component of claim 11, wherein the first and second external electrodes are further disposed respectively on first and second end surfaces of the body, the first and second end surfaces connecting the first and second surfaces.

15. The coil component of claim 14, wherein the insulating cover part is disposed on a portion of the first and second external electrodes that is disposed on the first and second end surfaces and is not disposed on a portion of the first and second external electrodes that is disposed on the first surface of the body.

* * * * *